US005358116A

United States Patent [19]

Brintazzoli

[11] Patent Number: 5,358,116

[45] Date of Patent: Oct. 25, 1994

[54] PACKAGE FOR CONTAINING TUBULAR PRODUCTS, SUCH AS VIALS AND THE LIKE

[75] Inventor: Renato Brintazzoli, Bologna, Italy

[73] Assignee: San S.R.L., Bologna, Italy

[21] Appl. No.: 135,959

[22] Filed: Oct. 13, 1993

Related U.S. Application Data

[63] Continuation of Ser. No. 856,085, Mar. 19, 1992, abandoned.

[30] Foreign Application Priority Data

Jul. 3, 1991 [IT] Italy ..... R091U000002

[51] Int. Cl.[5] ..... B65D 85/42

[52] U.S. Cl. ..... 206/485; 206/443; 206/539

[58] Field of Search ..... 206/485, 528, 538, 539, 206/589, 443

[56] References Cited

U.S. PATENT DOCUMENTS 2,582,476 1/1952 Buttery .

FOREIGN PATENT DOCUMENTS 0501509 5/1952 Belgium .
0639781 11/1963 Belgium ..... 206/485
0676012 12/1963 Canada ..... 206/485
0715714 9/1931 France ..... 206/485
0753750 10/1933 France ..... 206/485
0757891 1/1934 France ..... 206/485
1033105 4/1953 France ..... 206/485
1114066 12/1955 France ..... 206/485
0442689 11/1948 Italy ..... 206/485
0448169 5/1949 Italy ..... 206/485
0455361 2/1950 Italy ..... 206/485
0457360 5/1950 Italy ..... 206/485
0263452 12/1949 Switzerland ..... 206/485
0276578 10/1951 Switzerland ..... 206/485
0714467 8/1954 United Kingdom .
1468888 3/1977 United Kingdom ..... 206/485

*Primary Examiner*—Jimmy G. Foster
*Attorney, Agent, or Firm*—McAulay Fisher Nissen Goldberg & Kiel

[57] ABSTRACT

A package includes a box, made of card-board, in which a support element, also made of card-board, is inserted. This U-shaped element has fixed wings, with coaxial holes, inside which products, e.g. vials are inserted. The edge of each hole has radial segments which engage the neck of the products and prevent them from slippage. The element of support can be provided with flaps with appendixes having heads which rest against the bottom and the cover of the box; in this way the bottom and the the neck are effectively protected.

4 Claims, 3 Drawing Sheets

PACKAGE FOR CONTAINING TUBULAR PRODUCTS, SUCH AS VIALS AND THE LIKE

This is a continuation-in-part, of application Ser. No. 07/856,085, filed Mar. 19, 1992, abandoned.

BACKGROUND OF THE INVENTION

The invention relates to the farmaceutical packaging field, particularly to the sector of the packaging of products, e.g. vials and the like, which are made of glass.

DESCRIPTION OF THE PRIOR ART

Tubular products, e.g. vials and the like, which are made of glass, must be kept in a package that can contain a plurality of them separate from one another and that prevents them sufficiently from breaking during the transport or the handling of the finished package.

A known package is constituted by a box in which an element of support (called "rondo" by the technicians of the field) is inserted.

The element of support is constituted by a corrugated card-board, folded in such a way as to form a plurality of flanked seats, with U-shaped section, and is glued to a lower card-board blank provided with only lateral wings folded vertically to close the ends of said seats.

The above mentioned package is complicated as far as the element of support is concerned; besides the presence of adhesive agents in the latter causes problems of environmental pollution on the disposal of the package.

In a further known package the element of support is made like a drawer by moulding a suitable plastic material.

Everybody knows the problems connected with the getting rid of the plastic articles, particularly if they are not biodegradable.

SUMMARY OF THE INVENTION

The object of the invention is to propose a package in which the products, such as vials and the like, are separated one from another and sufficiently protected from breaking during the transport or the use of the package.

Another object of the invention is to propose a package which does not involve the use of adhesive agents or plastic materials and is made of a material that does not present ecological problems connected with the disposal of the package.

A further object of the invention is to propose a package formed in such a way that it does not cause the contact between the products during the removal of one of them effected by the user.

The above described objects are achieved by a package for containing tubular products, vials and the like, with each of these products constituted by a cylindrical body and a neck mutually connected by a narrowing, and with said package comprising a box, the internal length of which is bigger than the length of said tubular products, an element od support inserted into said box for supporting at least one tubular product, said element having U-shaped section and being provided with wings, first and second respectively, parallel to the bottom and to the cover of said box, with said first wing having at least a first through hole in which the body of said products is inserted, and with said second wing having at least a second through hole, made coaxial with said first hole, the edge of said second hole having radial splits which form flexible segments which elastically hold said neck of said tubular product.

BRIEF DESCRIPTION OF THE DRAWINGS

The characteristics of the invention will be described with reference to the accompanying drawings, in which.

DESCRIPTION OF THE PREFERRED EMBODIMENT

Figure 1:
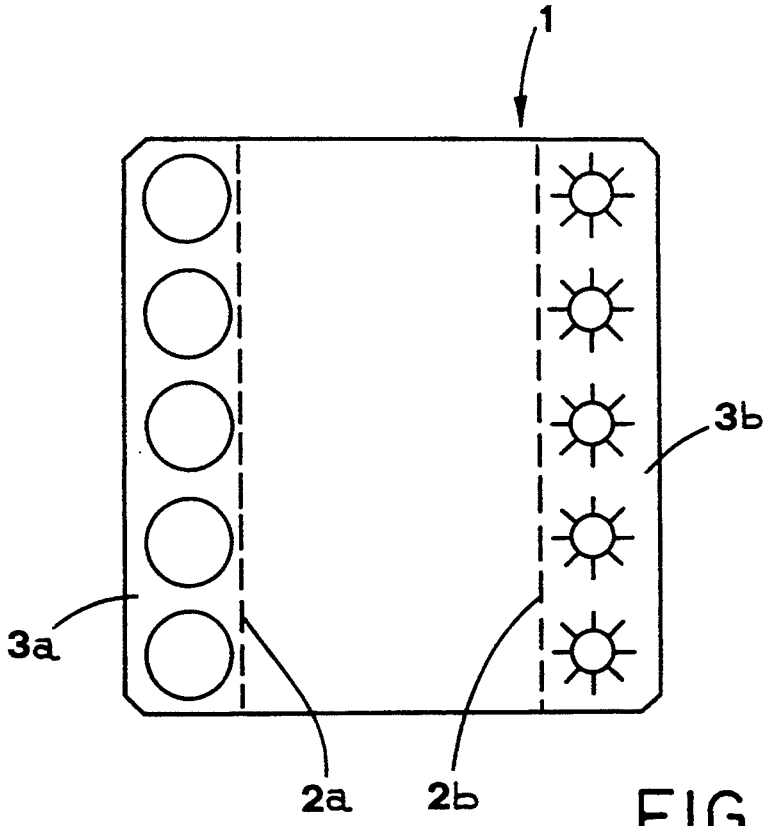
FIG. 1 shows a plan view of the blank from which it is possible to obtain the element of support according to a first embodiment.
Figure 2:
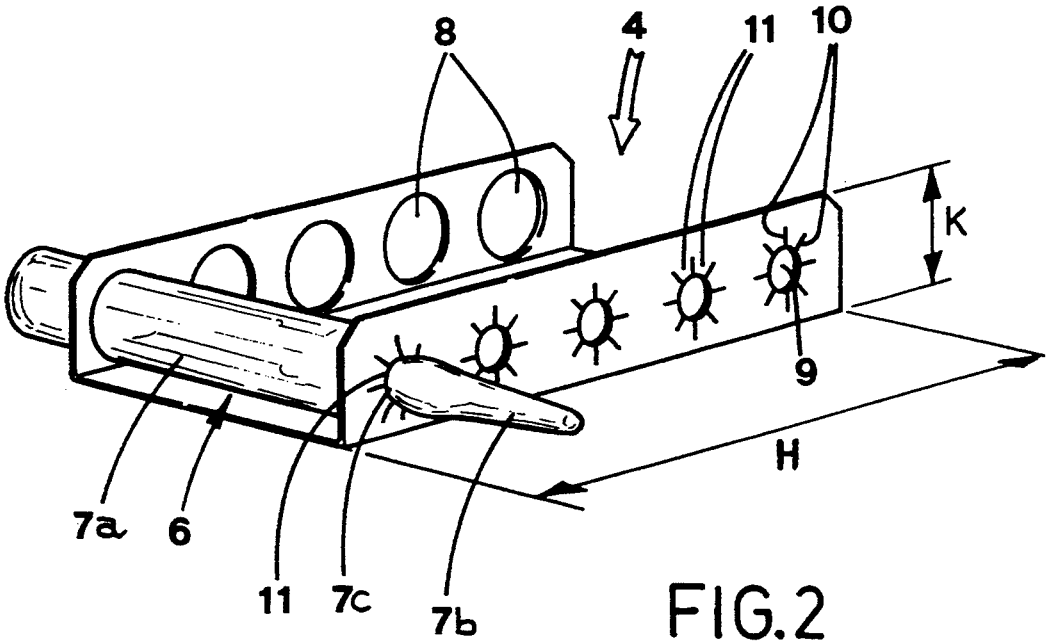
FIG. 2 shows a perspective view of the element of support according to the first embodiment while it is used.
Figure 5:
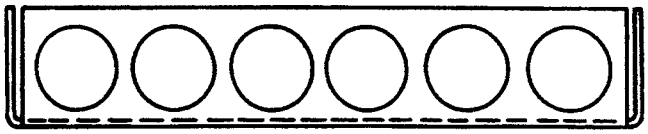
FIGS. 5, 6 show what is shown in FIG. 4, as it is seen according to the directions A, B respectively.

With reference to the FIGS. 1 and 2, numeral 1 indicates a blank of card-board with two longitudinal fold lines 2*a*, 2*b*.

These fold lines delimit two wings 3*a*, 3*b* which can be folded in the same direction, along the fold lines, so as to define an element of support 4 with longitudinal U-shaped section (FIG. 2).

Figure 7:
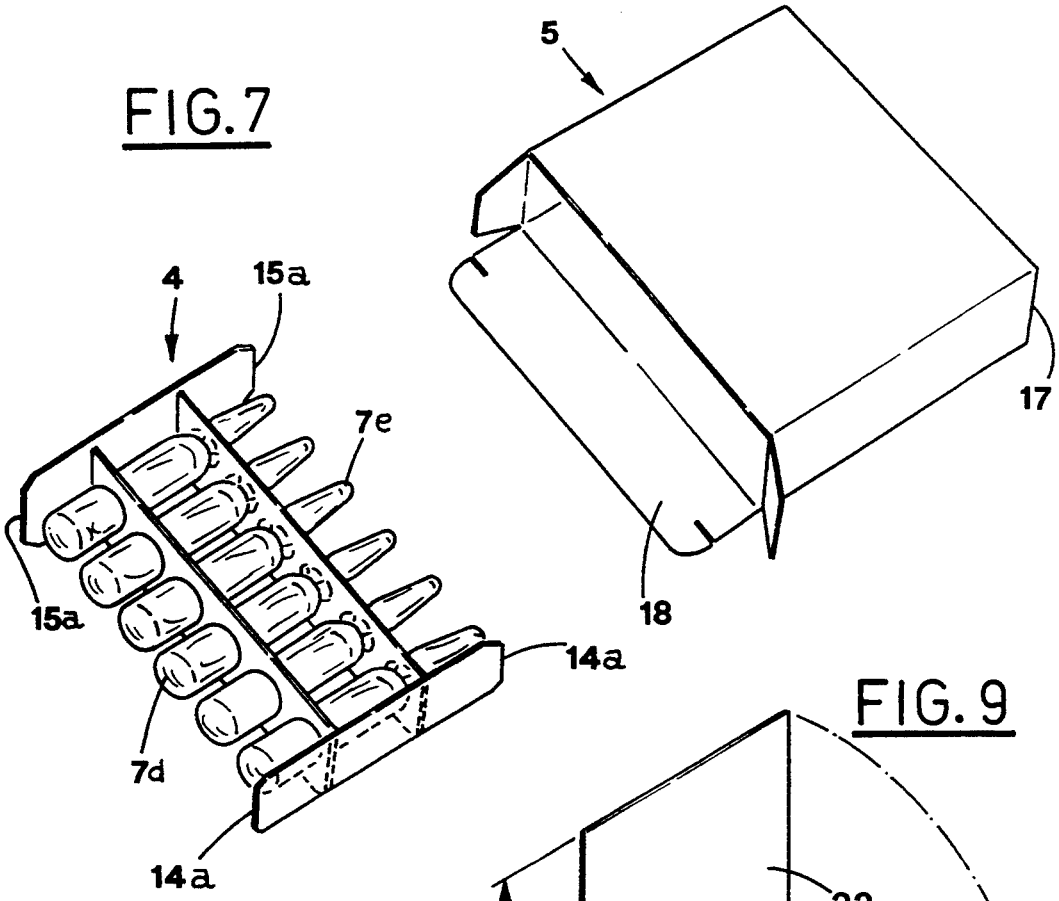
FIG. 7 shows an exploded view of the components of the proposed package.

The dimensions H, K of this element are not superior to the internal width and height of the correspondent box 5 (FIG. 7).

Numeral 6 indicates a tubular product (e.g. vial) constituted by a cylindrical body 7*a* and a neck 7*b* mutually connected by a narrowing 7*c*; the length of this vial is inferior to the internal length of the box 5.

The first wing 3*a* has a series of first through holes 8, with a predetermined distance from each other.

The second wing 3*b* has a series of through holes 9, of diameter smaller than the diameter of previously cited holes.

Each second hole 9 is coaxial with a related first hole 8, and the edge of each second hole has radial splits that define flexible segments 11.

The insertion of a vial 6 into the element 4 takes place in the following way.

The neck 7*b* is made to pass through a first hole 8, until it inserts in a second hole 9, correspondent to the previous one, remaining engaged therein because of the elastic flexion of the segments 11.

Hence the hole 8 lets the body 7*a* glide smoothly, until the narrowing 7*c* is positioned in correspondence with the segments 11.

The external diameter of the narrowing is larger then the diameter of the second hole 9, and therefore after the connection has been accomplished the segments 11 remain slightly bent.

This is extremely profitable since it allows to block the vial 6 in the element 4 thus avoiding the axial gliding of the vial in case of accidental stresses of the box 5, inside which there is the support 4 with the vial 6.

By accidental stresses it is meant those resulting from the transport of the package or from its handling (e.g.

placing the package in a relative space, handling of the package by the user etc.).

Due to the element 4 the the vials 6, blocked therein, are prevented from hitting each other.

When it is desired to protect efficiently the bottom 7*d* and/or the external end 7*e* of the vial, the embodiments illustrated by the FIGS. 3, 4, 5, 6, 7, 8, 9 should be used.

Figure 3:
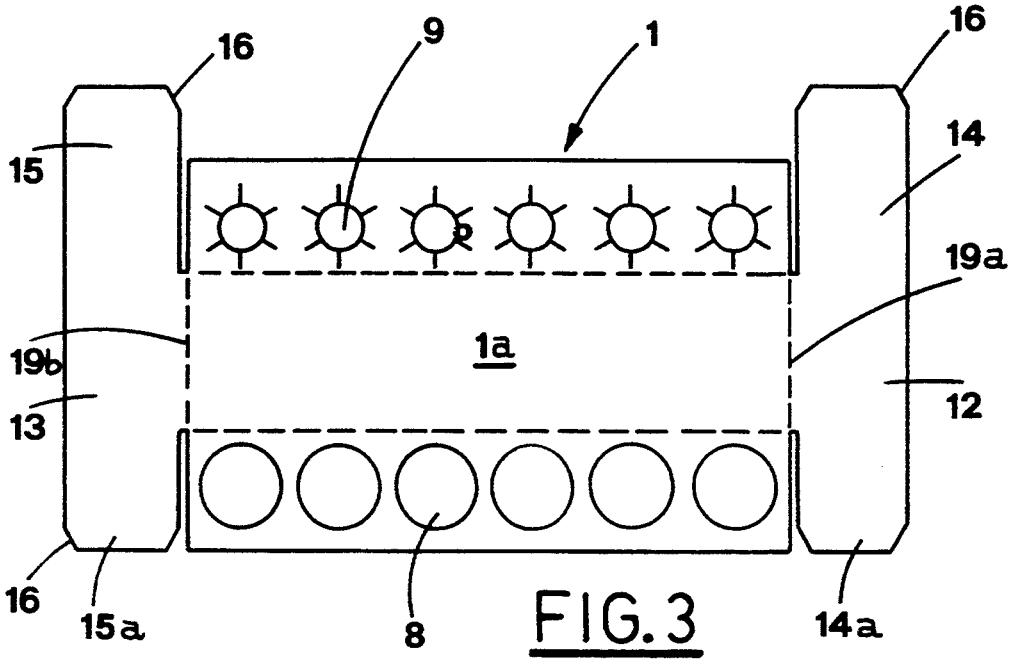
FIG. 3 shows a top plan view of the blank from which it is possible to obtain the element of support relative to a second embodiment.

From the FIG. 3 it results evident that two flaps 12, 13 extend from the sides of the base 1*a* of the blank that do not have the wings.

The flaps 12 and 13, which are coplanar with the base 1*a* and hinged to it by two fold lines 19*a*, 19*b*, have two longitudinal appendixes 14 and 15.

These flaps are folded like the wings 3*a*,3*b* in order to form the second embodiment of the element 4 (FIGS. 4, 5, 6, 7).

Figure 4:
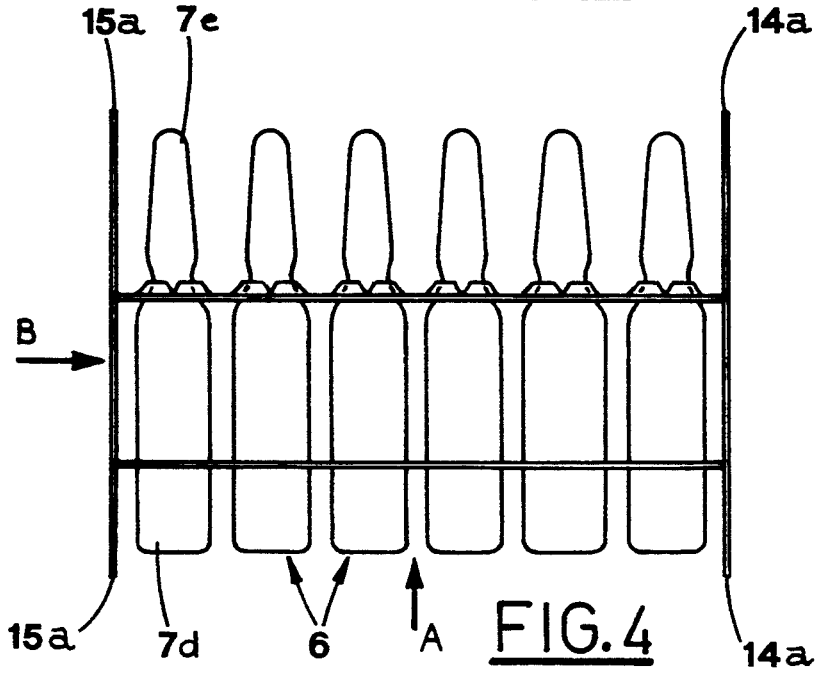
FIG. 4 shows a front view of the element of support in use and according to the second embodiment.
Figure 6:
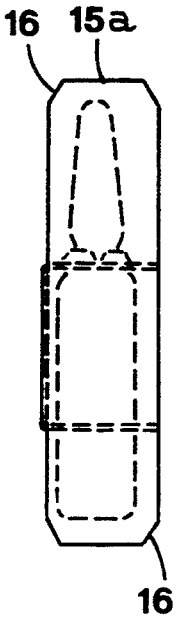

Preferably, the height of the flaps is the same as the height of the wings 3*a*, 3*b* (FIG.5), while the heads 14*a*, 15*a* of the cited appendixes 14, 15 are jutting in respect of the bottom 7*d* and the top 7*e* of each vial (FIGS. 4, 6).

When the element 4, with the related flaps, is inserted in the box 5, the cited heads 14*a*, 15*a* constitute an efficient rest part for the bottom 17 and the cover 18 of the box 5.

The corners of the heads 14*a*, 15*a* have bluntings 16 that help the insertion of the closing edges of the bottom and the cover of the box.

The element 4, obtained in this way, with the vials blocked in it, is showed by the FIGS. 4, 5, 6, 7 while the same FIG. 7 shows the components of the package, i.e. the element 4 and the box 5 for containing the same.

The structure of the element of support 4 allows to optimize the use of the space available the box and at the same time it contributes to stiffen the package obtained from the box 5 and the element 4 with relative vials 6.

In order to remove a vial 6 from the package it is necessary to draw the element 4 out of the box and slip a vial out of the relative holes 8, 9; to do this it is enough to overcome the elastic reaction of the segments 11.

This operation does not cause possible hits between the vial being slipped out and the other vials, neither hits between the latters.

Figure 8:
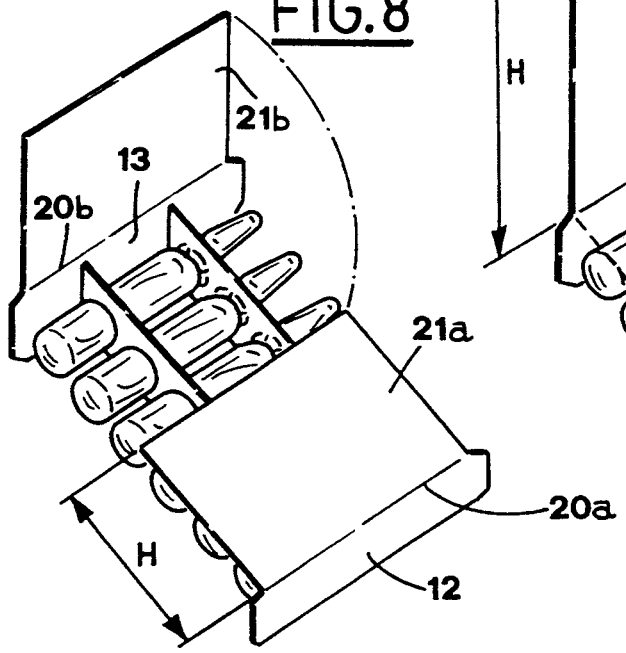
FIGS. 8, 9 show a perspective view of two variations of the element of support.
Figure 9:
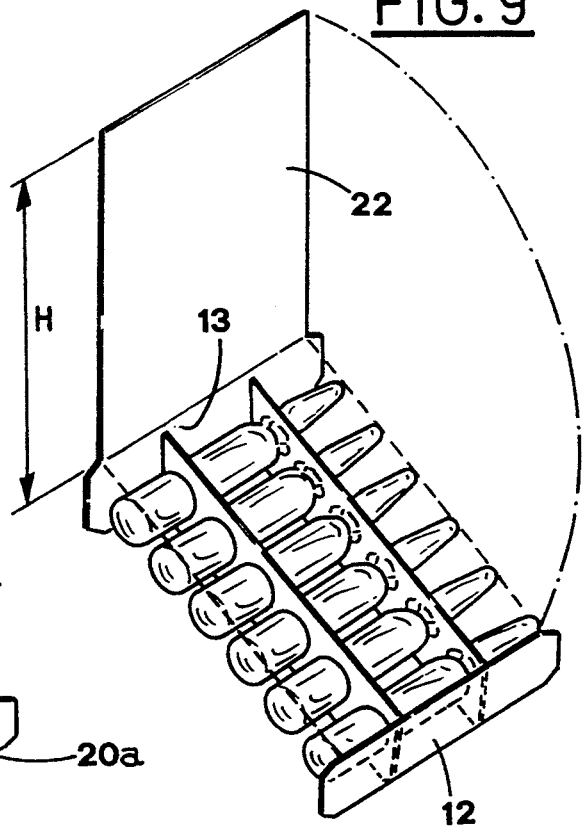

In order to protect still more efficiently the vials 6 and at the same time to stiffen the package, there are provided the variations showed by the FIGS. 8, 9.

In the variation of the FIG. 8, there are two tabs 20*a* and 20*b*, respectively hinged to the upper longitudinal edges of the flaps 12 and 13, by means of fold lines 21*a* and 21*b*.

The width of each tab is equal to H/2, therefore the same tabs when folded inwards cover one side of the element 4; in this way the vials are efficiently protected from accidental stresses and the package obtained is stiffer than the one showed by FIG. 7.

In the variation of FIG. 9 there is provided only one tab 22, of the width equal to H. The tab 22 is hinged to one of the flaps 12, 13.

The element of support 4, in both the embodiments and the considered variations, can be obtained from a blank of card-board; therefore, there are no problems connected with performing the operative phases which define the final structure of the element 4.

The structure of the element 4 is such that it optimizes the use of the space available in the box, i.e. allows to save card-board with consequent positive effect on the costs of the package.

The element 4 once used, i.e. after the user has taken all the vials out of it, does not provoke problems with its disposal, that is extremely advantageous from an ecological point of view.

Obviously the holes 8 and correspondent holes 9, can be of different diameters, with the possibility to block vials 6 of different dimensions in the element 4.

What is claimed is:

1. In a package for containing tubular products, each of these products constituted by a cylindrical body and a neck, a narrowing portion mutually connecting the body to the neck, said package comprising a box having a length that is longer than said tubular products, a U-shaped support element inserted into said box for supporting at least one tubular product, said support element having a base, a first wing and a second wing each wing having a first edge journaled to an opposite end of said base, and each wing having a second edge which is free, the free edge being opposite to the journaled edge, the wings being upright and the plane of the wings being parallel to each other, said base having two free sides, said first wing having at least a first through hole into which the body of said product is inserted, said second wing having at least a second through hole, made coaxial with said first hole, the second hole approximating the diameter of the narrowing portion, an edge of said second hole having radial splits which form flexible segments which elastically permit the passage of the neck therethrough and which hold said narrowing portion of said tubular product therein.

2. In a package for containing tubular products, each of these products constituted by a cylindrical body and a neck, a narrowing portion mutually connecting the body to the neck, said package comprising a box having a length that is longer than said tubular products, a U-shaped support element inserted into said box for supporting at least one tubular product, said support element having a base, a first wing and a second wing each wing having a first edge journaled to an opposite end of said base, and, each wing having a second edge which is free, the free edge being opposite to the journaled edge, the wings being upright and the plane of the wings being parallel to each other, the base having two side edges, two flaps hinged to the side edges of said base between said wings, said first wing having at least a first through hole into which the body of said product is inserted, said second wing having at least a second through hole, made coaxial with said first hole, the second hole approximating the diameter of the narrowing portion, an edge of said second hole having radial splits which form flexible segments which elastically permit the passage of the neck therethrough and which hold said narrowing portion of said tubular product therein;

means being hinged to at least one of said flaps to cover and protect the tubular product held in said support element.

3. A package, according to claims 2, wherein said covering and protecting means including one tab hinged to one of said flaps.

4. A package, according to claim 2, wherein said covering and protecting means include two tabs, each tab hinged to one of said flaps.

* * * * *